US006171743B1

(12) United States Patent
Nakamura

(10) Patent No.: US 6,171,743 B1
(45) Date of Patent: Jan. 9, 2001

(54) ELECTROSTATIC LATENT IMAGE-DEVELOPING TONER

(75) Inventor: Mitsutoshi Nakamura, Kawanishi (JP)

(73) Assignee: Minolta Co., Ltd., Osaka (JP)

( * ) Notice: Under 35 U.S.C. 154(b), the term of this patent shall be extended for 0 days.

(21) Appl. No.: 09/411,832

(22) Filed: Oct. 4, 1999

(30) Foreign Application Priority Data

Oct. 5, 1998 (JP) ..... 10-282330

(51) Int. Cl.[7] ..... G03G 9/08

(52) U.S. Cl. ..... 430/110; 430/111; 430/137

(58) Field of Search ..... 430/137, 106, 430/110, 111

(56) References Cited

U.S. PATENT DOCUMENTS

| | | | | |
|---|---|---|---|---|
| 4,996,126 | | 2/1991 | Anno et al. | 430/106.6 |
| 5,578,407 | | 11/1996 | Kasuya et al. | 430/106 |
| 5,622,802 | * | 4/1997 | Demizu et al. | 430/137 |
| 5,885,743 | | 3/1999 | Takayanagi et al. | 430/110 |
| 5,928,831 | * | 7/1999 | Nakamura | 430/137 |
| 6,022,661 | * | 2/2000 | Kurose et al. | 430/110 |

FOREIGN PATENT DOCUMENTS

| | | |
|---|---|---|
| 61-91666 | 5/1986 | (JP) . |
| 63-25664 | 2/1988 | (JP) . |
| 63-319037 | 12/1988 | (JP) . |
| 5-11497 | 1/1993 | (JP) . |
| 6-222613 | 8/1994 | (JP) . |

* cited by examiner

*Primary Examiner*—John Goodrow
(74) *Attorney, Agent, or Firm*—Burns, Doane, Swecker & Mathis, LLP

(57) ABSTRACT

The present invention relates to an electrostatic latent image-developing toner produced by a wet granulation method, containing at least a binder resin and a colorant, and having a volume-area mean particle size (D) of 1 to 10 $\mu$m, a shape coefficient (S) of 103 to 130, and a constant (A) of 0.25 to 2;

the volume-area mean particle size (D) being defined by the below equation (1):

$$D = \frac{\sum (ni \times (Di)^3)}{\sum (ni \times (Di)^2)} \quad (1)$$

wherein "ni" and "Di" respectively denote "the number of particle" and "particle size (representative diameter)" of each particle size division in the distribution of number-standard particle size;

the shape coefficient (S) being defined by the below equation (2):

$$S = \frac{(\text{perimeter})^2}{\text{area}} \times \frac{1}{4\pi} \times 100 \quad (2)$$

wherein "perimeter" and "area" respectively denote perimeter and area of the projected image of toner particle; and the constant (A) being defined by the below equation (3):

$$A = \frac{SB}{SW} - 1 \quad (3)$$

wherein "SB" denotes a BET specific surface and "SW" is defined by the below equation:

$$SW = \frac{6 \times S}{\rho \times D \times 100}$$

wherein "ρ" denotes a specific gravity of toner, "D" and "S" respectively denote the above-mentioned volume-area mean particle size (D) and shape coefficient (S).

16 Claims, No Drawings

ELECTROSTATIC LATENT IMAGE-DEVELOPING TONER

This application is based on Japanese Patent Application No. Hei 10-282330 filed in Japan, the content of which is hereby incorporated by reference.

BACKGROUND OF THE INVENTION

1. Field of the Invention

The present invention relates to an electrostatic latent image-developing toner.

2. Description of the Related Art

An emulsified dispersion method has been conventionally known as one of methods for producing resin particles. In such a method, a resin solution obtained by dissolving a resin in a non-aqueous organic solvent is emulsifiedly dispersed in an aqueous medium to form an emulsion, and the emulsion is heated under continuous stirring to remove the organic solvent by allowing it to evaporate, whereby resin particles are obtained. According to the emulsified dispersion method, polymer fine particles having a mean particle size of about 1 to 10 $\mu$m can be obtained with a comparatively easy operation simplifying a process, so that the emulsified dispersion method can improve a production efficiency and, at the same time, cost reduction as compared to a pulverization method and a suspension polymerization method. Further, the number of kind of resin usable in the emulsified dispersion method is more than that in the suspension polymerization method and the like.

Accordingly, it is expected that, if such a emulsified dispersion method is put into practical use to blend toner components, such as a colorant, a charge control agent and a magnetic powder, into the resin solution, an electrostatic latent image-developing toner answering needs with respect to fields of a coping machine and a printer in an electrophotograghic system, such as high speed, high picture quality and coloration, can be comparatively easily obtained at a low price. For example, Japanese Patent Application Laid-Open Nos. 91,666/1986 and 25,664/1988 disclose a manufacturing method for an electrostatic latent image-developing toner, in which the emulsified dispersion method is applied.

However, the toner obtained by the emulsified dispersion method has many air caves inside, because water is easily taken into an oily droplet in O/W type emulsion at a step for emulsifiedly dispersing. Therefore, there is the problem that a chargeability changes easily due to a change of surrounding environments and imaging properties tend to be adversely affected.

SUMMARY OF THE INVENTION

It is an object of the present invention to provide an electrostatic latent image-developing toner which can maintain a good charge stability and good imaging properties for a long time even when surrounding environments change.

The object of the present invention can be achieved by an electrostatic latent image-developing toner produced by means of a wet granulation method, containing at least a binder resin and a colorant, and having a volume-area mean particle size (D) of 1 to 10 $\mu$m, a shape coefficient (S) of 103 to 130, and a constant (A) of 0.25 to 2, in which;

the volume-area mean particle size (D) is defined by the below equation (1):

$$D = \frac{\sum (ni \times (Di)^3)}{\sum (ni \times (Di)^2)} \tag{1}$$

wherein "ni" and "Di" respectively denote "the number of particle" and "particle size (representative diameter)" of each particle size division in the distribution of number-standard particle size;

the shape coefficient (S) is defined by the below equation (2):

$$S = \frac{(\text{perimeter})^2}{\text{area}} \times \frac{1}{4\pi} \times 100 \tag{2}$$

wherein "perimeter" and "area" respectively denote perimeter (peripheral length) and area of the projected image of toner particle;

the constant (A) is defined by the below equation (3):

$$A = \frac{SB}{SW} - 1 \tag{3}$$

wherein "SB" denotes a BET specific surface and "SW" is defined by the below equation:

$$SW = \frac{6 \times S}{\rho \times D \times 100}$$

wherein "ρ" denotes a specific gravity of toner, "D" and "S" respectively denote the above-mentioned volume-area mean particle size (D) and shape coefficient (S).

DETAILED DESCRIPTION OF THE INVENTION

The electrostatic latent image-developing toner of the present invention contains at least a binder resin and a colorant and has a volume-area mean particle size (D) of 1 to 10 $\mu$m, a shape coefficient (S) of 103 to 130, and a constant (A) of 0.25 to 2.

When a toner has many air caves inside, the moisture in the air is easily taken into toner by the capillarity of the air caves connected to toner surface and the minute unevenness on toner surface, so that a chargeability changes due to a change of the surrounding environments and imaging properties are adversely affected. The electrostatic latent image-developing toner of the present invention can maintain a stable chargeability and good imaging properties even when a change of the surrounding environments occures, by optimizing a volume-area mean particle size (D), a shape coefficient (S), and a constant (A) defined in the above equations (1) to (3).

The volume-area mean particle size (D) is defined by the below equation (1):

$$D = \frac{\sum (ni \times (Di)^3)}{\sum (ni \times (Di)^2)} \tag{1}$$

wherein "ni" and "Di" respectively denote "the number of particle" and "particle size (representative diameter)" of each particle size division in the distribution of number-standard particle size, means a ratio of the sum total of volume of particles measured in number-standard to the sum total of area of those, and is also called a specific surface particle size.

The volume-area mean particle size (D) can be measured by Coulter Multisizer (made by Coulter Counter K.K.). However, the volume-area mean particle size (D) does not need to be necessarily measured by the above-mentioned apparatus, and any apparatus may be used as long as it is capable of carrying out measurement and calculation of mean particle size based on the above-mentioned equation (1).

The shape coefficient (S) is defined by the below equation (2):

$$S = \frac{(\text{perimeter})^2}{\text{area}} \times \frac{1}{4\pi} \times 100 \quad (2)$$

wherein "perimeter" and "area" respectively denote perimeter (peripheral length) and area of the projected image of toner particle. In the present invention, the "S" value is calculated as a mean value of two hundreds of toner particles. The shape coefficient (S) is an index showing a overall shape of toner particle and means that the closer the value to 100, the closer the toner particle shape in the projected image to true sphericity.

In the present description, as for the perimeter and area of the projected image of toner particle, the value measured by means of SEM image of toner particles (magnification of 1,000 to 5,000) from LUZEX 5000 (made by Nihon Regulator K.K.) is used. However, a measuring apparatus for photography and the apparatus for measurement are not especially limited to the above apparatus as long as they are respectively capable of taking a photograph of toner particles and measuring the perimeter and area of toner particles.

The constant (A) is defined by the below equation (3):

$$A = \frac{SB}{SW} - 1 \quad (3)$$

wherein "SB" denotes a BET specific surface and "SW" is defined by the below equation:

$$SW = \frac{6 \times S}{\rho \times D \times 100}$$

wherein "ρ" denotes a specific gravity of toner, "D" and "S" respectively denote the above-mentioned volume-area mean particle size (D) and shape coefficient (S).

The constant (A) is an index showing surface properties of toner particles and means that the closer the value is to 0, the fewer the air caves are that are connected to the toner surface and the minute unevenness on toner surface so that toner particles have smooth surface. Thus, the constant (A) is prescribed by a ratio of "SB" to "SW" so that the surface properties of the toner particles are precisely reflected by the constant (A).

In the present description, the toner specific gravity (ρ) and the BET specific surface (SB) are respectively measured by Air Comparison Pyonometer Model 930 (made by BECKMAN K.K.) and Flow Sorb 2300 (made by Shimazu Seisakusyo K.K.) . However, a measuring apparatus is not especially limited to the above apparatus as long as it is capable of carrying out measurement based on the same principle as the above-mentioned apparatus.

With respect to the toner of the present invention, if the "S" value exceeds 130 or the "A" value exceeds 2, the moisture in the air is taken into toner by the capillarity of the air caves connected to toner surface and the minute unevenness on toner surface so that a chargeability changes due to a change of the surrounding environments and imaging properties are adversely affected and, further, toner is likely to chip off so that imaging properties worsen. If "S" value is less than 103 or the "A" value is less than 0.25, toner shape is of perfectly true sphericity and toner does not have irregularities on surface so that a place to which the moisture selectively adsorbs is lost and the moisture absorbs to the opening between toner particles by capillarity. In such a state of toner, toner particles are likely to be prevented from moving so that electrification-build-up properties of toner worsen and an electrification-environmental stability also worsens.

Therefore, the preferable toner in the present invention has a volume-area mean particle size (D) of 1 to 10 μm, a shape coefficient (S) of 103 to 120 and a constant (A) of 0.25 to 1.

The binder resin constituting an electrostatic latent image-developing toner of the present invention is not particularly limited, and known resins which have been conventionally used as binder resins for toners, such as, for example, styrene resins, (metha)acrylic resins, styrene-(metha)acrylic copolymer resins, olefin resins, polyester resins, polyamide resins, carbonate resins, polyether, polyvinyl acetate resins, polysulfone, epoxy resins, polyurethane resins, and urea resins, may be used alone or in combination of two or more kinds.

Further, it is desirable that such binder resins have a glass transition point (Tg) between 50 and 70° C., a number-average molecular weight (Mn) between 1,000 and 50,000, preferably between 3,000 and 20,000, and a molecular weight distribution shown by a ratio of weight-average molecular weight to Mn (Mw/Mn) of 2 to 60. When the glass transition point (Tg) is less than 50° C., the heat-resistance properties of the toner obtained are reduced. When it exceeds 70° C., the fixing properties of the toner obtained is reduced. When the number-average molecular weight (Mn) is less than 1,000, high-temperature offset tends to occur about the toner obtained. When Mn exceeds 50,000, on the contrary, low-temperature offset tends to occur. When Mw/Mn is less than 2, non-offset range tends to be narrow about the toner obtained. When Mw/Mn exceeds 60, low-temperature offset tends to occur. If the toner of the present invention is used as a toner for oil-applied fixation, it is more desirable to use a binder resin having Mw/Mn of 2 to 5. If the toner is used as a toner for oilless fixation, it is more desirable to use a binder resin having Mw/Mn of 20 to 50.

With respect to the colorant contained in an electrostatic latent image-developing toner of the present invention, various kinds and colors of organic or inorganic pigments listed below may be used. These colorants may form a master batch in combination with a binder resin or other resins and the master batch may be added in order to improve dispersing properties in the toner.

As for black pigments, for example, carbon black, copper oxide, manganese dioxide, aniline black, active carbon, non-magnetic ferrite, magnetic ferrite, magnetite, etc. are exemplified.

As for yellow pigments, for example, chrome yellow, zinc yellow, cadmium yellow, yellow iron oxide, mineral fast yellow, nickel titanium yellow, nable yellow, naphtol yellow S, Hansa Yellow G, Hansa Yellow 10G, benzidine yellow G, benzidine yellow GR, quinoline yellow lake, permanent yellow NCG, Tartrazine lake, etc. are exemplified.

As for orange pigments, for example, red chrome yellow, molybdenum orange, permanent orange GTR, pyrazolone orange, vulcan orange, Indanthrene Brilliant Orange RK, benzidine orange G, Indanthrene Brilliant Orange GK, etc. are exemplified.

As for red pigments, for example, iron oxide red, cadmium red, minium, mercury sulfide, cadmium, permanent red 4R, resol red, pyrazolone red, watching red, calcium salt, Lake Red C, Lake Red D, Brilliant Carmine 6B, Eosine Lake, Rhodamine Lake B, alizarine lake, Brilliant Carmine 3B, etc. are exemplified.

As for violet pigments, for example, manganese violet, fast violet B, methyl violet lake, etc. are exemplified.

As for blue pigments, for example, Prussian blue, cobalt blue, alkali blue lake, Victorian Blue Lake, phthalocyanine blue, non-metal phthalocyanine blue, phthalocyanine blue partial chloride, Fast Sky Blue, Indanthrene Blue BC, etc. are exemplified.

As for green pigments, for example, chrome green, chrome oxide, pigment green B, malachite green lake, final yellow green G, etc. are exemplified.

As for white pigments, for example, zinc white, titanium oxide, antimony white, zinc sulfide, etc. are exemplified.

As for extender pigments, for example, barytes powder, barium carbonate, clay, silica, white carbon, talc, alumina white, etc. are exemplified.

With respect to an amount of addition of these colorants, it is preferable to use 2 to 10 parts by weight of these colorants with respect to 100 parts by weight of the binder resin.

Besides the above-mentioned binder resins and colorants, toner components, such as a charge-control agent, an anti-offset agent and a magnetic powder, may be contained in the electrostatic latent image-developing toner of the present invention.

The charge-control agent may be contained when satisfactory electrification properties can not be achieved by the binder resin and the colorant only.

With respect to such charge-control agents, various substances which can impart a positive or negative charge through frictional charging are known. As for positive charge-control agent, for example, nigrosine dyes, such as Nigrosine Base EX (made by Orient Kagaku Kogyo K.K.), quaternary ammonium salts, such as quaternary ammonium salt P-51 (made by Orient Kagaku Kogyo K.K.) and Copy Charge PX VP435 (made by Hoechst Japan K.K.), alkoxylated amine, alkyl amide, molybdenum acid chelate pigments, and imidazole compounds, such as PLZ1001 (made by Shikoku Kasei Kogyo K.K.), etc. are exemplified. As for negative charge-control agent, for example, metallic complexes, such as Bontrons S-22, S-34, E-81, E-84 (made by Orient Kagaku Kogyo K.K.) and Spilon Black TRH (made by Hodogaya Kagaku Kogyo K.K.), quaternary ammonium salts, such as thioindigo pigments and Copy Charge NX VP434 (made by Hoechst Japan K.K.), and calix arene compounds, such as Bontron E-89 (made by Orient Kagaku Kogyo K.K.), boron compounds, such as LR147 (made by Nippon Karritto K.K.), and fluorine compounds, such as magnesium fluoride and carbon fluoride, etc. are exemplified. However, the charge-control agent is not limited to these. Metallic complexes, which are negative charge-control agent, include complexes having various structures, such as metallic complexes of oxycarboxylic acid, metallic complexes of dicarboxylic acid, metallic complexes of amino acid, metallic complexes of diketone, metallic complexes of diamine, metallic complexes having azo group containing benzen-benzen derivatives skeleton, and metallic complexes having azo group containing benzen-naphthalene derivatives skeleton as well as the above-mentioned complexes. An amount of addition thereof is preferably set to 0.1 to 10 parts by weight with respect to 100 parts by weight of the binder resin.

The anti-offset agent is not particularly limited, and known anti-offset agent which have been conventionally used in order to improve fixing properties of the toner. For example, various waxes, in particular, polyolefin waxes, such as low molecular weight polypropylene, polyethylene, or oxidized-type polypropylene, polyethylene may be used. An amount of addition thereof is preferably set to 0.1 to 20 parts by weight with respect to 100 parts by weight of the binder resin.

With respect to the magnetic powder, magnetite, γ-hematite or various ferrites, etc. are exemplified. An amount of addition thereof is preferably set to 10 to 200 parts by weight with respect to 100 parts by weight of the binder resin.

The toner of the present invention, as described above, can be produced by a known wet granulation method, such as an emulsified dispersion method, a suspension polymerization method, an emulsion polymerization method, etc. In other words, the toner of the present invention is produced by once obtaining toner particles by the wet granulation method and then subjecting the obtained toner particles to a surface treatment. With respect to a production method of toner particles, the emulsified dispersion method is preferably used from the viewpoint of production efficiency and cost reduction. The case, where toner particles are produced by the emulsified dispersion method and are then subjected to surface treatment to give the toner of the present invention, is described below. However, even when toner particles are produced by the other known wet granulation methods, that is, a suspension polymerization method, an emulsion polymerization method, etc. and are then subjected to surface treatment, the toner of the present invention can be obtained by optimizing conditions of the surface treatment.

When an emulsified dispersion method is used as production method of toner particles, an electrostatic latent image-developing toner of the present invention is produced by:

- dissolving and/or dispersing at least the above-mentioned binder resin and colorant in a non-aqueous organic solvent to prepare a colored resin solution;
- emulsifiedly dispersing the colored resin solution in an aqueous medium to form an O/W type emulsion, or adding an aqueous medium to the colored resin solution and causing a phase reversal for emulsification to form an O/W type emulsion; and
- removing the non-aqueous organic solvent from droplets of the emulsion to give toner particles, and then subjecting the toner particles to surface treatment.

In producing the toner of the present invention, in detail, the above-mentioned binder resin, colorant and, when necessary, other toner components are first dissolved and/or dispersed in a non-aqueous organic solvent to prepare a colored resin solution. When toner particles are obtained by such an emulsified dispersion method, a resin, which is soluble in a non-aqueous organic solvent as will be described later and is insoluble or hardly soluble in water, is used as the binder resin.

With respect to the non-aqueous organic solvent used in order to produce the electrostatic latent image-developing toner of the present invention, any solvent which is insoluble or hardly soluble in water and dissolves the above-mentioned binder resins may be used. For example, toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methylethylketone, methylisobutylketone, a mixture thereof etc. are used alone or in combination. Among them, aromatic solvents such as toluene and xylene, and halogenated hydrocarbons such as methylene chloride, 1,2-dichloroethane, chloroform and carbon tetrachloride are preferably used.

When dissolving and/or dispersing the toner components in the non-aqueous organic solvent, a commonly-used device, such as a ball mill, a sand grinder and an ultrasonic homogenizer, may be adopted.

A solid content concentration in the colored resin solution should be controlled to such concentration as droplets of an O/W type emulsion can be readily solidified into fine particles when the O/W type emulsion is heated for removing non-aqueous organic solvent from the droplets. In particular, it is desirable that the concentration of polymer component in this resin solution is about 5 to 50% by weight, preferably about 10 to 40% by weight.

The colored resin solution, thus prepared, is then emulsified and dispersed in an aqueous medium to form an O/W type emulsion, or an aqueous medium is added to the colored resin solution to cause a phase reversal for emulsification so that an O/W type emulsion is formed. When the colored resin solution is emulsified and dispersed in an aqueous medium to form an O/W type emulsion, the mixture of the colored resin solution with the aqueous medium is sufficiently stirred by a stirring apparatus, such as homomixer. With respect to stirring time, it is preferably not less than 10 minutes. If the stirring time is too short, the toner particles having a sharp particle-size distribution may not be obtained.

When an aqueous dispersion is added to the colored resin solution to cause a phase reversal for emulsification so that an O/W type emulsion is formed, an aqueous medium is added to the colored resin solution while the colored resin solution is stirred by a stirring apparatus, such as homomixer, and the addition is stopped at the time of occurrence of a phase reversal. The mixture is then stirred sufficiently. With respect to stirring time, it is also preferably not less than 10 minutes.

The particle size of each droplet of the colored resin solution in the emulsion is directly related to the size of toner particles that will be finally obtained. Therefore, it is necessary to adjust the droplet size that can provide the final size of the toner particles, and also to control the particle-size distribution thereof sufficiently.

In formation of an O/W type emulsion, it is desirable that a ratio (Vp/Vw) of the volume of the colored resin solution (Vp) to the volume of the aqueous medium (Vw) is $Vp/Vw \leqq 1$, preferably $0.3 \leqq Vp/Vw \leqq 0.7$. If the ratio is $Vp/Vw > 1$, a stable O/W type emulsion can not be formed and a phase transition may occur, or a W/O type emulsion may be formed.

An aqueous medium usable for formation of an O/W type emulsion can be basically water and may contain such a quantity of aqueous organic solvent as will not break down the emulsion. For example, water, a water/methanol mixed solution (weight ratio: 50/50 to 100/0), a water/ethanol mixed solution (weight ratio: 50/50 to 100/0), a water/acetone mixed solution (weight ratio: 50/50 to 100/0), and a water/methyl ethyl ketone mixed solution (weight ratio: 70/30 to 100/0) can be used.

It is desirable that some suitable dispersion stabilizer is added to such an aqueous medium. With respect to the dispersion stabilizer, those substances that form hydrophilic colloid in the aqueous medium are used. In particular, the following substances are exemplified: gelatin, Arabic rubber, agar, cellulose derivatives (such as hydroxymethylcellulose, hydroxyethylcellulose and hydroxypropylcellulose), synthetic polymers (such as polyvinylalcohol, polyvinyl pyrrolidone, polyacrylamide, salts of polyacrylic acids, and salts of polymethacrylic acids) , etc. Solid fine powder can be also usable. For example, the following substances are exemplified: tribasic calcium phosphate, calcium carbonate, calcium sulfate, barium carbonate, silica, titanium oxide, alumina, etc. In the present invention, it is more desirable to use the aqueous medium containing polyvinylalcohol as a dispersion stabilizer, because air caves are hardly formed in toner particles and the above-mentioned constant (A) can be easily controlled.

If required, a dispersion stabilizing assistant may be added to the aqueous medium. With respect to the dispersion stabilizing assistant, surface active agents are usually used. For example, the following agents are exemplified: natural surface active agents including saponin, nonionic surface active agents, such as alkylene oxide-based, glycerin-based, and glycidol-based surface active agents, and anionic surface active agents containing acid groups, such as carboxyl group, sulfonic acid group, phosphoric acid group, sulfate group, and phosphate group. In particularly, preferable combination of the dispersion stabilizer with the dispersion stabilizing assistant is the one of cellulose derivatives (methylcellulose derivatives) with anionic surface active agents (sodium dodecylbenzene sulfonate), or the one of polyvinylalcohol with anionic surface active agents.

Next, the non-aqueous organic solvents are removed from droplets of the O/W type emulsion to form toner particles.

In formation of toner particles, a whole system may be heated slowly so that the non-aqueous organic solvent in droplets is completely removed to form toner particles. Alternatively, an O/W type emulsion may be sprayed in a dry atmosphere so that the non-aqueous organic solvent in droplets is completely removed and, at the same time, the aqueous medium is removed by being allowed to evaporate to form toner particles. With respect to the dry atmosphere where the O/W type emulsion is sprayed, for example, various gases, such as air, nitrogen, carbon dioxide gas and combustion gas, which is heated to 20° C. to 250° C. In particular, such various gas streams heated to a temperature higher than the boiling point of the solvent having the highest boiling point in the used solvents are generally usable. When a solid fine powder, such as tribasic calcium phosphate as a dispersion stabilizer, it is preferable that a whole system is heated slowly to remove the non-aqueous organic solvent in droplets. More preferably, the non-aqueous organic solvent is removed over not less than 2 hours while the whole system is heated slowly. Because shapes of toner particles can be easily controlled.

If required, toner particles obtained are furthermore subjected to the steps of washing, drying and classifying, etc., whereby an electrostatic latent image-developing toner having a sharp particle-size distribution can be obtained in the present invention.

The toner particles, obtained above, are then subjected to a surface treatment. With respect to the surface treatment, any methods may be used as long as the above-mentioned "D" value, "C" value and "A" value of toner, in particular, "A" value can be controlled and, for example, a method wherein heat or stress can be applied to the toner particles in an aqueous phase or an air current, etc. is usable. With respect to the method wherein heat or stress is applied in the aqueous phase or air current, the following methods are shown: a method wherein beads are added to the aqueous suspension obtained by suspending toner particles and the suspension is then mixed and stirred, a method wherein the aqueous suspension, obtained by suspending toner particles, is mixed and stirred by a mixing machine, a method wherein toner particles are dried and then subjected to a hot air current treatment, and a method wherein toner particles are dried, beads are added thereto and the mixture is then mixed and stirred. In each method, it is not always necessary to treat the particles at not less than the glass transition point of the binder resin. Because it is enough to seal or smooth toner surface to such a degree as the moisture in the air is not absorbed into toner particles by the capillarity. It is not necessary to change a whole shape of toner. In the case where beads are added to the aqueous suspension obtained by suspending toner particles and the suspension is then mixed and stirred, it is preferable to treat at a temperature lower than the glass transition point of the binder resin.

When beads are added to the aqueous suspension obtained by suspending toner particles and the suspension is then mixed and stirred, the height of the liquid level is preferably set within the range of 100±30% with respect to the height of beads level on condition that an aqueous suspension and beads are put into a container. A dispersion medium of the aqueous suspension is generally water and may be a mixed medium of water with an aqueous organic solvent. With respect to the aqueous organic solvent, for example, methanol, ethanol, i-propanol, and n-propanol, etc. may be used. The use of the mixed medium improves dispersing properties to water. In the mixed medium, a volume-ratio of water to the aqueous organic solvent is preferably 10/10 to 10/0. If the volume ratio of aqueous organic solvent is too high in the mixed medium, toner may be swelled and fused together.

With respect to a material of beads, glass, zirconium and alumina, etc. are preferably used. Preferably, the beads have a diameter between 0.2 and 5 mm. With respect to a device for stirring with beads, a commonly-used device, such as a ball mill and a sand grinder (made by Igarashi Kikai K.K.), etc. are useful. The device body is filled with the beads preferably in the range of 10 to 60% by volume with respect to the internal volume of the body. Preferably, stirring time is 1 to 120 minutes and stirring speed is 10 to 1,000 rpm.

When an aqueous suspension is mixed and stirred by a mixing machine as a surface treatment, a dispersion medium of an aqueous suspension is the same dispersion medium as in the above-mentioned stirring case by beads. With respect to the mixing machine, any machine can be used as long as it can apply stress to materials to be treated. For example, TK Homomixer (made by Tokushukika Kogyo K.K.) and Ultra Turrax (made by IKA Japan K.K.), etc. are exemplified. Preferably, stirring time is 1 to 120 minutes and stirring speed is 3,000 to 10,000 rpm.

When toner particles are dried and then subjected to a hot air current treatment as a surface treatment, a known hot air current treatment apparatus, such as Surfusing System (made by Nihon Pneumatic K.K.), Hybridization System (made by Nara Kikai Seisakusho K.K.) and Angmill (made by Hosokawa Micron K.K.), etc. are usable. In Surfusing System, the highest temperature in the apparatus is preferably fixed to 50 to 200° C. In Hybridization System, residence time is preferably 1 to 60 minutes.

With respect to the toner of the present invention which has been subjected to such a surface treatment, the air caves connected to its surface and the minute unevenness have been sealed at any event so that the toner of the present invention has good smooth properties. Therefore, the toner of the present invention can have the above-mentioned "D" value, "S" value and "A" value, and can maintain a good electrification stability and good imaging properties for a long time even when surrounding environments change.

To the toner of the present invention, a fluidizing agent and a cleaning assist agent may be further added. With respect to the fluidizing agent, inorganic fine particle, such as silica, alumina, titanium oxide, zinc oxide, iron oxide, copper oxide, lead oxide, antimony oxide, yttrium oxide, magnesium oxide, barium titanate, ferrite, red oxide, magnesium fluoride, silicon carbide, boron carbide, silicon nitride, zirconium nitride, magnetite, and magnesium stearate, etc. are exemplified. Such inorganic fine particles may be surface-treated in order to improve dispersing properties on the toner particle surface and an environmental stability. With respect to the surface-treatment agent, for example, silane coupling agents, titanate coupling agents, higher fatty acids, and silicon oils, etc. are exemplified. With respect to the cleaning assist agent, for example, polystyrene fine particles and polymethyl methacrylate fine particles, etc. are used. It is desirable that these fluidizing agents and cleaning assist agents are respectively added in an amount of addition of 0.1 to 20 parts by weight with respect to 100 parts by weight of toner.

The toner of the present invention can be used as both a mono-component developer without a carrier and a two-component developer with a carrier. With respect to carriers used in combination with the toner of the present invention, known carriers can be used. For example, a carrier of magnetic particles, such as iron powder and ferrite, a coated carrier in which the surface of the magnetic particles are coated with a coating agent such as resin, and a dispersion type carrier in which magnetic fine particles are dispersed in a binder resin, are usable. Such carriers preferably have a volume-mean particle size of 15 to 100 $\mu$m, more preferably 20 to 80 $\mu$m.

The toner of the present invention has few air caves and little irregularities on the surface thereof and shows a good electrification stability even when environments change.

Further, the toner of present invention can provide copy-images having no fog even after repeatedly used.

The toner of the present invention will be described in more detail by the following examples.

EXAMPLES

Example 1

| | parts by weight |
|---|---|
| polyester resin (softening point: 95° C., Tg: 65° C., Mn = 3,500, Mw/Mn = 2.5) | 100 |
| copper phthalocyanine blue pigment (made by Toyo Ink Seizo K.K.) | 4 |
| charge control agent: Bontron E-84 (made by Orient Kagaku Kogyo K.K.) | 2 |

The above-mentioned materials were added to 400 parts by weight of toluene as a solvent. The mixture was then treated for 30 minutes by a supersonic homogenizer (output 400 $\mu$A) so that the materials were dissolved and/or dispersed in the solvent to give a colored resin solution.

Four parts by weight of polyvinylalcohol PA18 (made by Shinetu Kagaku Kogyo K.K.) as a dispersion stabilizer and 0.1 part by weight of sodium lauryl sulfate (made by Wako Junyaku K.K.) as a dispersion stabilizing assistant were dissolved in 100 parts by weight of water to give an aqueous dispersion (aqueous solution for dispersion). While one hundred parts by weight of the aqueous dispersion were agitated by TK homomixer (made by Tokushu Kika Kogyo K.K.) at 4500 rpm, 50 parts by weight of the colored resin solution were introduced dropwise into the aqueous dispersion to be suspended in water. Thereafter, toluene was removed under the conditions of 50° C., 100 mmHg and 5 hours, and filtration and washing with water were repeated. Five parts by weight of the resulting toner particles were suspended in 100 parts by weight of water and to this aqueous suspension were added glass beads having a diameter of 1 mm and the mixture was stirred for 60 minutes at 300 revolutions per minute by a ball mill with the temperature maintained at 50° C. The device body was filled with the beads in 50% by volume with respect to the internal volume of the body. When the aqueous suspension and beads were put into the device, the height of the liquid level was equal to the height of beads level. The resulting toner particles were dried to give "toner mother particles 1".

Example 2

| | parts by weight |
|---|---|
| styrene-n-butyl methacrylate resin (softening point: 98° C., Tg: 65° C., Mn = 8,300, Mw/Mn = 2.3) | 100 |
| carbon black: MA#8 (made by Mitubishi Kasei K.K.) | 6 |
| charge control agent: Bontron P-51 (made by Orient Kagaku Kogyo K.K.) | 2 |

The above-mentioned materials were added to 400 parts by weight of toluene as a solvent. The mixture was then treated for 30 minutes by a supersonic homogenizer (output 400 $\mu$A) so that the materials were dissolved and/or dispersed in the solvent to give a colored resin solution.

Four parts by weight of tribasic calcium phosphate (made by Wako Junyaku K.K.) as a dispersion stabilizer and 0.1 part by weight of sodium lauryl sulfate (made by Wako Junyaku K.K.) as a dispersion stabilizing assistant were dissolved and/or dispersed in 100 parts by weight of water to give an aqueous dispersion. While one hundred parts by weight of the aqueous dispersion were agitated by TK homomixer at 5,000 revolutions per minute, 50 parts by weight of the colored resin solution were introduced dropwise into the aqueous dispersion to be suspended in water. Thereafter, toluene was removed under the conditions of 50C., 100 mmHg and 5 hours. The tribasic calcium phosphate was dissolved by concentrated hydrochloric acid and then filtration and washing with water were repetitively carried out. Five parts by weight of the resulting toner particles were suspended in 100 parts by weight of a water/methanol mixed medium (volume ratio: water/methanol=5/1). The suspension was stirred for 30 minutes at 4,000 revolutions per minute by TK homomixer with the aqueous suspension maintained at 50° C. The resulting toner particles were dried to give "toner mother particles 2".

Example 3

| | parts by weight |
|---|---|
| polyester resin (softening point: 103° C., Tg: 68° C., Mn = 6,900, Mw/Mn = 2.2) | 100 |
| quinacridone pigment (made by Dainichi Seika K.K.) | 4 |
| charge control agent: Bontron E-81 (made by Orient Kagaku Kogyo K.K.) | 2 |

The above-mentioned materials were added to 400 parts by weight of toluene as a solvent. The mixture was then treated for 30 minutes by a supersonic homogenizer (output 400 $\mu$A) so that the materials were dissolved and/or dispersed in the solvent to give a colored resin solution.

Four parts by weight of polyvinylalcohol PA05 (made by Shinetu Kagaku Kogyo K.K.) as a dispersion stabilizer and 0.1 part by weight of sodium lauryl sulfate (made by Wako Junyaku K.K.) as a dispersion stabilizing assistant were dissolved in 100 parts by weight of water to give an aqueous dispersion. While one hundred parts by weight of the aqueous dispersion were agitated by TK homomixer at 3,600 revolutions per minute, 50 parts by weight of the colored resin solution were introduced dropwise into the aqueous dispersion to be suspended in water. Thereafter, toluene was removed under the conditions of 50° C., 100 mmHg and 5 hours, and filtration and washing with water were repetitively carried out and then toner particles were dried. The resulting toner particles were subjected to a hot air current treatment at 120° C. by Surfusing System (made by Nihon Pneumatic K.K.) to give "toner mother particles 3".

Comparative Example 1

Toner mother particles 4 were prepared in the same way as in Example 1, except that the treatment by the ball mill was not carried out in Example 1.

Comparative Example 2

Toner mother particles 5 were prepared in the same way as in Example 2, except that toluene was removed rapidly under the conditions of 60° C., 20 mmHg and 1 hours in Example 2.

Comparative Example 3

Toner mother particles 6 were prepared in the same way as in Example 3, except that the hot air current treatment was not carried out in Example 3.

Comparative Example 4

Toner mother particles 7 were prepared in the same way as in Example 3, except that the temperature of the heat treatment by Surfusing System was changed to 300° C. in Example 3.

With respect to the resultant toner mother particles, a volume-area mean particle size (D), a shape coefficient (S), and a constant (A) were measured and calculated as described below and results were presented in Table 1.

Volume-area mean particle size (D)

A volume-area mean particle size (D) was measured by Coulter Multisizer (made by Coulter K.K.).

Shape coefficient (S)

A perimeter and an area of toner particle were measured on the basis of a SEM picture (magnification of 1,500) taken by LUZEX 5000 (made by Nihon Regulator). A shape coefficient (S) was calculated from the measurements (equation (2)). The values of both the perimeter and area of toner particle were calculated as an average of 200 particles. Constant (A)

A specific gravity of toner (ρ) was measured by Air Comparison Pyonometer Model 930 (made by BECKMAN K.K.) and, from this measurement and above-mentioned "S" value and "D" value, "SW" value was calculated. A BET specific surface area (SB) was measured by Flow Sorb 2300 (made by Simazu Seisakusho K.K.) and, from the this measurement and above-mentioned "SW" value, "A" value was calculated (equation (3)).

TABLE 1

| | D | S | A |
|---|---|---|---|
| Example 1 | 4.46 | 103.5 | 0.48 |
| Example 2 | 8.74 | 117.8 | 0.90 |
| Example 3 | 6.67 | 108.8 | 0.63 |
| Comparative Example 1 | 4.57 | 107.5 | 2.36 |
| Comparative Example 2 | 9.53 | 142.4 | 1.89 |
| Comparative Example 3 | 6.73 | 110.1 | 3.18 |
| Comparative Example 4 | 6.44 | 101.8 | 0.19 |

To toner mother particles 1 and 4 were respectively added 0.5% by weight of silica fine particles (H-200; made by Hoechst Japan K.K.) and 1% by weight of titanium dioxide fine particles (T-805; made by Nippon Aerosil K.K.). The mixture was mixed by Henschel Mixer for three minutes to give toners 1 and 4. To toner mother particles 2 and 5 were respectively added 0.3% by weight of silica fine particles (R-974; made by Nippon Aerosil K.K.). The mixture was mixed by Henschel Mixer for two minutes to give toners 2 and 5. To toner mother particles 3, 6 and 7 were respectively added 0.9% by weight of silica fine particles (R-976; made by Nippon Aerosil K.K.). The mixture was mixed by Henschel Mixer for two minutes to give toners 3, 6 and 7.

Preparation of Carrier

| | parts by weight |
|---|---|
| polyester resin (softening point: 123° C., Tg: 65° C., AV = 230, HV = 40) | 100 |
| ferrite fine particles: MFP-2 (made by TDK K.K.) | 500 |
| carbon black: MA#8 (made by Mitubishi Kasei K.K.) | 2 |

Above-mentioned materials were sufficiently mixed by Henschel Mixer, and kneaded by a twin screw-extruder. Thereafter, the kneaded materials were cooled, coarsely pulverized by a feather mill, and then treated by a jet grinder and an air classifier to give carrier particles having an average particle size of 50 μm.

(Evaluation method)

1) Electrific charge amount

The toners obtained in Examples 1 to 3 and Comparative Example 1 to 4 were respectively mixed with the carrier at the toner ratio of 5% by weight with respect to carrier to prepare 30 g of developing agents. Each developing agent was introduced into a polyethylene bottle having a capacity of 50 cc and the bottle was then rotated for 30 minutes at 120 rpm. The resultant developing agent was kept for three hours in LL environment (10° C., 15%) and HH environment (30° C., 85%) and was then subjected to measurement of the electrically charged amount.

2) Copied-image properties

Toners of Example 1 and Comparative Example 1 were respectively mixed with the carrier to prepare the developing agent having a toner concentration of 5%. These developing agents were respectively subjected to durability test in which duplication was carried out on 10,000 sheets of paper by means of LIMOS 900 (made by Minolta K.K.). Copied images were evaluated at the initial stage and at the stage after copy of 10,000 sheets. Toners of Example 2 and Comparative Example 2 were respectively mixed with the carrier to prepare the developing agent having a toner concentration of 5%. These developing agents were respectively subjected to durability test in which duplication was carried out on 100,000 sheets of paper by means of EP-4051 (made by Minolta K.K.). Copied images were evaluated at the initial stage and after copy of 100,000 sheets. Toners of Example 3 and Comparative Examples 3 and 4 were respectively subjected to durability test in which duplication was carried out on 3,000 sheets of paper by means of Page Pro 15 (made by Minolta K.K.). Copied images were evaluated at the initial stage and after copy of 3,000 sheets. Where no fog was found, the toner was ranked as "○". Where slight fog was found but not objectionable from the practical use, the toner was ranked as "Δ". Where many fogs were found, the toner was ranked as "X".

The results were presented in Table 2.

TABLE 2

| | Charged amount (μC/g) | | Imaging property | |
|---|---|---|---|---|
| | LL | HH | initial stage | many sheet stage |
| Example 1 | −25.3 | −22.5 | ○ | ○ |
| Example 2 | +23.4 | +21.7 | ○ | ○ |
| Example 3 | −32.5 | −20.1 | ○ | ○ |
| Comparative Example 1 | −27.7 | −11.2 | Δ | X |
| Comparative Example 2 | +24.5 | +13.0 | Δ | X |
| Comparative Example 3 | −35.8 | −8.9 | Δ | X |
| Comparative Example 4 | −34.2 | −15.6 | Δ | X |

From the results, it can be clearly understood that toners of Examples 1 to 3 in the present invention show a sufficient electrification stability even when environments change and can provide good copied images at the initial stage and after repetition of copy. With respect to Comparative Examples 1 to 4, the change of electrification amount of toner caused by environmental change was large. Slight fog was found in the initial copying stage. After the durability test, fog was further increased.

What is claimed is:

1. An electrostatic latent image-developing toner produced by a wet granulation method, containing at least a binder resin and a colorant, and having a volume-area mean particle size (D) of 1 to 10 μm, a shape coefficient (S) of 103 to 130, and a constant (A) of 0.25 to 2, the volume-area mean particle size (D) being defined by the below equation (1):

$$D = \frac{\sum (ni \times (Di)^3)}{\sum (ni \times (Di)^2)} \quad (1)$$

wherein "ni" and "Di" respectively denote "the number of particle" and "particle size (representative diameter)" of each particle size division in the distribution of number-standard particle size;

the shape coefficient (S) being defined by the below equation (2):

$$S = \frac{(\text{perimeter})^2}{\text{area}} \times \frac{1}{4\pi} \times 100 \quad (2)$$

wherein "perimeter" and "area" respectively denote perimeter and area of the projected image of toner particle; and the constant (A) being defined by the below equation (3):

$$A = \frac{SB}{SW} - 1 \quad (3)$$

wherein "SB" denotes a BET specific surface and "SW" is defined by the below equation:

$$SW = \frac{6 \times S}{\rho \times D \times 100}$$

wherein "ρ" denotes a specific gravity of toner, "D" and "S" respectively denote the above-mentioned volume-area mean particle size (D) and shape coefficient (S).

2. The toner of claim 1, wherein the shape coefficient (S) is 103 to 120.

3. The toner of claim 1, wherein the constant (A) is 0.25 to 1.

4. The toner of claim 1, wherein the wet granulation method is an emulsified dispersion method in which a resin solution comprising a binder resin, a colorant and a non-aqueous organic solvent is added to an aqueous medium to emulsifiedly disperse so that an O/W type emulsion is formed, and the non-aqueous organic solvent is removed from droplets of the emulsion to give toner particles.

5. The toner of claim 1, wherein the wet granulation method is a phase-reversely emulsified dispersion method in which an aqueous medium is added to a resin solution comprising a binder resin, a colorant and a non-aqueous organic solvent to cause a phase reversal for dispersion so that an O/W type emulsion is formed, and the non-aqueous organic solvent is removed from droplets of the emulsion to give toner particles.

6. The toner of claim 4, wherein the toner particles are surface-treated by heat at 50 to 200° C.

7. The toner of claim 4, wherein the toner particles are surface-treated by mixing and stirring an aqueous suspension containing the toner particles with beads added therein.

8. The toner of claim 7, wherein the surface-treatment is carried out at a temperature less than a glass transition point of the binder resin.

9. The toner of claim 7, wherein the beads have a diameter between 0.2 and 5 mm.

10. The toner of claim 5, wherein the toner particles are surface-treated by heat at 50 to 200° C.

11. The toner of claim 5, wherein the toner particles are surface-treated by mixing and stirring an aqueous suspension containing the toner particles with beads added therein.

12. The toner of claim 11, wherein the surface-treatment is carried out at a temperature less than a glass transition point of the binder resin.

13. The toner of claim 11, wherein the beads have a diameter between 0.2 and 5 mm.

14. The toner of claim 1, wherein the binder resin has a glass transition point between 50 and 70° C., a number-average molecular weight between 1,000 and 50,000, and a molecular weight distribution (weight-average molecular weight/number-average molecular weight) between 2 and 60.

15. The toner of claim 14, wherein the binder resin has a molecular weight distribution between 2 and 5.

16. The toner of claim 14, wherein the binder resin has a molecular weight distribution between 20 and 50.

* * * * *